US011713554B2

(12) United States Patent
Isaac

(10) Patent No.: US 11,713,554 B2
(45) Date of Patent: Aug. 1, 2023

(54) APPARATUS FOR REMOVABLE INSERTION INTO AN EXCAVATED TRENCH TO PROTECT WORKER AGAINST COLLAPSE OF TRENCH WALL

(71) Applicant: Kirby W. Isaac, Steinbach (CA)

(72) Inventor: Kirby W. Isaac, Steinbach (CA)

( * ) Notice: Subject to any disclaimer, the term of this patent is extended or adjusted under 35 U.S.C. 154(b) by 0 days.

(21) Appl. No.: 16/712,325

(22) Filed: Dec. 12, 2019

(65) Prior Publication Data

US 2020/0308797 A1 Oct. 1, 2020

(30) Foreign Application Priority Data

Mar. 25, 2019 (CA) ..... CA 3037938

(51) Int. Cl.
*E02D 17/08* (2006.01)

(52) U.S. Cl.
CPC ..... *E02D 17/08* (2013.01)

(58) Field of Classification Search
CPC combination set(s) only.
See application file for complete search history.

(56) References Cited

U.S. PATENT DOCUMENTS 984,337 A * 2/1911 Woodworth
1,007,723 A * 11/1911 Moore ..... E02D 17/08 405/272
1,847,814 A * 3/1932 Byrne, Jr. ..... E02D 23/14 405/248
2,002,987 A * 5/1935 Schulz ..... E21D 11/15 405/153
3,859,802 A * 1/1975 Platner ..... E21D 11/15 405/152
5,081,802 A * 1/1992 Westhoff ..... B28B 7/168 404/26
5,401,122 A * 3/1995 Pate, Jr. ..... E02D 17/08 405/133
7,090,434 B1 * 8/2006 Thompson, Jr. ..... E02D 9/02 405/226
2006/0086011 A1 * 4/2006 Zandwijk ..... E02D 23/14 37/347
2011/0318116 A1 * 12/2011 Cosentino ..... E02D 29/124 405/272

* cited by examiner

*Primary Examiner* — Kyle Armstrong
(74) *Attorney, Agent, or Firm* — Christopher J. Dynowski; Ryan W. Dupuis; Ade & Company Inc.

(57) ABSTRACT

An apparatus for removable insertion into an excavated trench to protect a worker against collapse of the trench wall, which is often termed in industry as a trench shield or cage or box, comprises cross members interconnecting opposite sides of a protective peripheral wall that are in the form of rounded annuluses. Additional members are provided to interconnect adjacent pairs of annuli which are spaced one from the other in a height direction of the wall. This forms an interconnected internal frame of the apparatus which primarily provides compressive strength of the apparatus against collapsing of the trench wall instead of the protective wall so that the protective wall may be made to be lighter in terms of mass. Further, the protective peripheral wall forms a tube substantially fully enclosing a working area defined by the wall.

8 Claims, 5 Drawing Sheets

APPARATUS FOR REMOVABLE INSERTION INTO AN EXCAVATED TRENCH TO PROTECT WORKER AGAINST COLLAPSE OF TRENCH WALL

This application claims the benefit of Canadian patent application ser. no. 3,037,938 filed Mar. 25, 2019.

FIELD OF THE INVENTION

The present invention relates generally to an apparatus for removable insertion into an excavated trench to protect a worker against collapse of the trench wall, which is often termed in industry as a trench shield or cage or box, and more particularly, in one aspect, to such an apparatus comprising cross members, which extend between opposite sides of a protective peripheral wall of the apparatus, forming rounded annuluses therebetween and in another aspect to such an apparatus comprising a tubular protective peripheral wall.

BACKGROUND

An apparatus for removable insertion into an excavated trench to protect a worker against collapse of the trench wall, which is often termed in industry as a trench shield or cage or box, conventionally comprises a pair of planar rectangular panels interconnected in spaced relation to one another by a plurality of linear cross members oriented perpendicularly to each of the panels. The apparatus is therefore substantially open at each adjacent pair of panel edges located in spaced opposite relation to one another at adjacent ends of the interconnected panels, so that when the apparatus is lowered into the trench, which is typically rectanguloid shaped so as to receive the rectanguloid trench shield, the panels are located adjacent an opposite pair of the trench walls so as to prevent collapsing movement of the ground material located thereat into a working space defined between the panels but either opposite pair of ends of the panels defines an opening through which the trench wall thereat may collapse into the working space between the panels.

SUMMARY OF THE INVENTION

According to one aspect of the invention there is provided an apparatus for removable insertion into an excavated trench, which is formed in a ground material and has a trench floor at a depth below a ground surface and an upright peripheral trench wall extending upwardly from the floor to the ground surface, to protect a worker in the excavated trench against collapse of the peripheral trench wall comprising:

an upright protective peripheral wall having substantially diametrically opposite first and second sides arranged to define a generally enclosed working area suited for receiving a worker therein, the protective peripheral wall generally encompassing an upstanding axis and extending from a bottom of the protective peripheral wall which is arranged to be located at or adjacent the trench floor to a top of the protective peripheral wall arranged to be located at a spaced height above the trench floor, so as to prevent collapsing movement into the working area of the ground material forming the peripheral trench wall at least at the substantially diametrically opposite locations of the working area;

the protective peripheral wall defining between the first and second sides thereof an entry opening at the top of the protective peripheral wall for entering the working area and an access opening at the bottom of the protective peripheral wall for providing access to the trench floor;

the protective peripheral wall having an interior surface facing the working area and an exterior surface for facing the peripheral trench wall; and a plurality of cross members interconnecting the first and second sides of the protective peripheral wall so as to maintain the first and second sides thereof in fixed spaced relation to one another;

the cross members extending from the interior surface thereof at the first side of the protective peripheral wall to the interior surface at the second side of the protective peripheral wall and forming at spaced locations across a height of the protective peripheral wall, which is measured between the bottom of the protective peripheral wall and the top thereof, a plurality of rounded annuluses each including opposite first and second arcs extending from the first side to the second side.

The rounded annuluses or annuli of this arrangement may provide greater compressive strength between the opposite sides of the protective peripheral wall as compared to linearly extending cross members such that the cross members may be made relatively lightweight to decrease overall mass of the apparatus, to the extent that the apparatus can be handled on site by a person without use of a crane or mechanical assistance, while still providing suitable compressive strength.

Preferably, each annulus encircles the working area and an aperture defined by an inner side of the annulus is sized substantially equal to the working area such that the working area is substantially unobstructed by the cross members forming the annuli.

In the illustrated arrangement, a first one of the annuluses is located at the top of the protective peripheral wall and a second one of the annuluses is located at the bottom of the protective peripheral wall.

In such an arrangement, preferably a third one of the annuluses is located centrally between the top and bottom of the protective peripheral wall.

Preferably, an upper surface of the first annulus is substantially flush with the top of the protective peripheral wall and a lower surface of the second annulus is substantially flush with the bottom of the protective peripheral wall such that another apparatus can be stacked on top in coaxial alignment. Therefore, the apparatus may be provided in generally shorter heights to further reduce its mass so as to render the apparatus more readily movable by hand without assistance of other equipment.

Preferably, the protective peripheral wall forms a tube extending along the upstanding axis around the cross members so as to substantially fully enclose the working area to prevent the collapsing movement into the working area of the ground material at any location on the peripheral trench wall around the working area.

Preferably, the protective peripheral wall includes first and second ends which are substantially diametrically opposite one another in a manner which is crosswise to the substantially diametrically opposite relation of the first and second sides, and the first and second ends of the protective peripheral wall are connected to the opposite first and second arcs of each annulus formed by the cross members such that the annulus also extends from the interior surface of the protective peripheral wall at the first end to the interior surface at the second end so as to maintain the first and second ends in fixed spaced relation to one another.

Preferably, when each annulus encircles the working area and an aperture defined by an inner side of the annulus is sized substantially equal to the working area such that the working area is substantially unobstructed by the cross members, and furthermore each of the cross members is in the form of a closed loop of a common shape, the interior surface of the protective peripheral wall follows the common shape of the annuluses and is connected to outer sides of the annuluses.

Preferably, the apparatus further includes a plurality of frame members interconnecting adjacent ones of the cross members which are spaced apart in a direction of the height of the protective peripheral wall.

Preferably, the frame members interconnect the adjacent cross members at locations thereon so as to be disposed at the interior surface of the protective peripheral wall, and the frame members also are connected to the protective peripheral wall. Thus the interconnecting frame members further brace the protective peripheral wall such that the tube may be reduced in mass, for example by reducing a thickness of the protective peripheral wall between the exterior and interior surfaces, while remaining suitably strong to retain any collapsing ground material outside the working area.

Preferably, each of the cross members is in the form of a closed loop so as to form both the first and second arcs of the annulus.

Preferably, each annulus is circular in shape.

Preferably, each annulus defines a plane which is oriented transversely to the upstanding axis.

In such an arrangement, preferably, centers of the annuluses are coaxially aligned along the upstanding axis located centrally of the working area.

In one arrangement, the protective peripheral wall comprises separate first and second portions defining diametrically opposite portions of the protective peripheral wall, and each cross member comprises a first portion attached to the first portion of the protective peripheral wall so as to form a first reinforced wall portion and a second portion separate from the first portion and attached to the second portion of the protective peripheral wall so as to form a second reinforced wall portion, the first and second reinforced wall portions being directly interconnectable.

In one such arrangement, the first portion of the respective cross member is unitarily attached to the first portion of the protective peripheral wall and the second portion is unitarily attached to the second portion of the protective peripheral wall.

In such arrangements, preferably, each of the first and second portions of the protective peripheral wall are shaped between opposite substantially vertically extending ends so as to be self-standing.

According to another aspect of the invention there is provided an apparatus for removable insertion in an excavated trench, which is formed in a ground material and has a trench floor at a depth below a ground surface and an upright peripheral trench wall extending upwardly from the floor to the ground surface, to protect a worker in the excavated trench against collapse of the peripheral trench wall comprising:

an upright protective peripheral wall having substantially diametrically opposite first and second sides arranged to define a generally enclosed working area suited for receiving a worker therein, the protective peripheral wall generally encompassing an upstanding axis and extending from a bottom of the protective peripheral wall which is arranged to be located at or adjacent the trench floor to a top of the protective peripheral wall arranged to be located at a spaced height above the trench floor, so as to prevent collapsing movement into the working area of the ground material forming the peripheral trench wall at least at the substantially diametrically opposite locations of the working area;

the protective peripheral wall defining between the first and second sides thereof an entry opening at the top of the protective peripheral wall for entering the working area and an access opening at the bottom of the protective peripheral wall for providing access to the trench floor;

the protective peripheral wall having an interior surface facing the working area and an exterior surface for facing the peripheral trench wall; and a plurality of cross members disposed at spaced locations across a height of the protective peripheral wall, which is measured between the bottom of the protective peripheral wall and the top thereof, and interconnecting the first and second sides of the protective peripheral wall so as to maintain the first and second sides thereof in fixed spaced relation to one another, the cross members extending from the interior surface thereof at the first side of the protective peripheral wall to the interior surface at the second side of the protective peripheral wall; and the protective peripheral wall forming a tube extending along the upstanding axis around the cross members so as to include first and second ends which are substantially diametrically opposite one another in a manner which is crosswise to the substantially diametrically opposite relation of the first and second sides of the protective peripheral wall, such that the working area is substantially fully enclosed to prevent the collapsing movement into the working area of the ground material at any location on the peripheral trench wall around the working area.

Preferably, the cross members are arranged such that outer sides thereof are disposed at the interior surface of the protective peripheral wall at the first and second ends, and the first and second ends of the protective peripheral wall are connected to the cross members so as to maintain the first and second ends in fixed spaced relation to one another.

Preferably, the apparatus further includes a plurality of frame members interconnecting adjacent ones of the cross members which are spaced apart in a direction of the height of the protective peripheral wall.

Preferably, the frame members interconnect the adjacent cross members at locations thereon so as to be disposed at the interior surface of the protective peripheral wall, and the frame members also are connected to the protective peripheral wall.

Preferably, the frame members are disposed at the interior surface at the first and second ends so as to be connected to the protective peripheral wall at the first and second ends. Thus the interconnecting frame members further brace the protective peripheral wall at the first and second ends such that the tube may be reduced in mass, for example by reducing a thickness of the protective peripheral wall between the exterior and interior surfaces, while remaining suitably strong to retain any collapsing ground material outside the working area.

In the illustrated arrangement, the tube is circular cylindrical in shape.

Preferably, the cross members form at the spaced locations across the height of the protective peripheral wall a plurality of rounded annuluses each including opposite first and second arcs extending from the first side to the second side; each annulus defines a plane which is oriented transversely to the upstanding axis; each annulus encircles the working area and an aperture defined by an inner side of the annulus is sized substantially equal to the working area such that the working area is substantially unobstructed by the cross members; and the first and second ends of the protective peripheral wall are connected to the opposite first and second arcs of each annulus formed by the cross members such that the annulus also extends from the interior surface of the protective peripheral at the first end to the interior surface at the second end so as to maintain the first and second ends in fixed spaced relation to one another.

In one arrangement, the protective peripheral wall comprises separate first and second portions defining diametrically opposite portions of the protective peripheral wall, and each cross member comprises a first portion attached to the first portion of the protective peripheral wall so as to form a first reinforced wall portion and a second portion separate from the first portion and attached to the second portion of the protective peripheral wall so as to form a second reinforced wall portion, the first and second reinforced wall portions being directly interconnectable.

In one such arrangement, the first portion of the respective cross member is unitarily attached to the first portion of the protective peripheral wall and the second portion is unitarily attached to the second portion of the protective peripheral wall.

In such arrangements, each of the first and second portions of the protective peripheral wall may span about 180 degrees about the upstanding axis.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
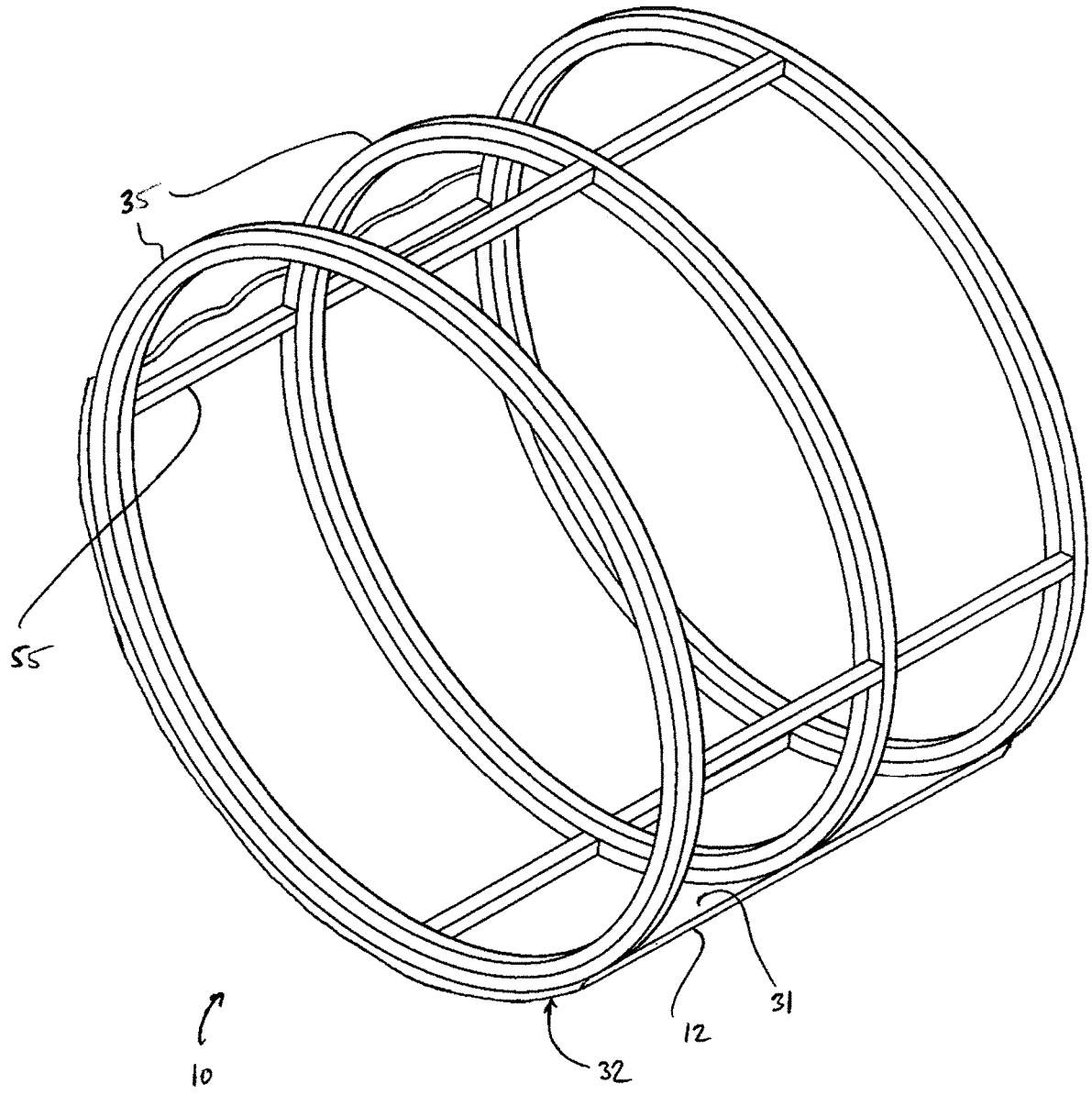
FIG. 1 is a perspective view of an arrangement of apparatus for removable insertion into an excavated trench according to the present invention, where a protective peripheral wall is shown as cutaway.
Figure 2:
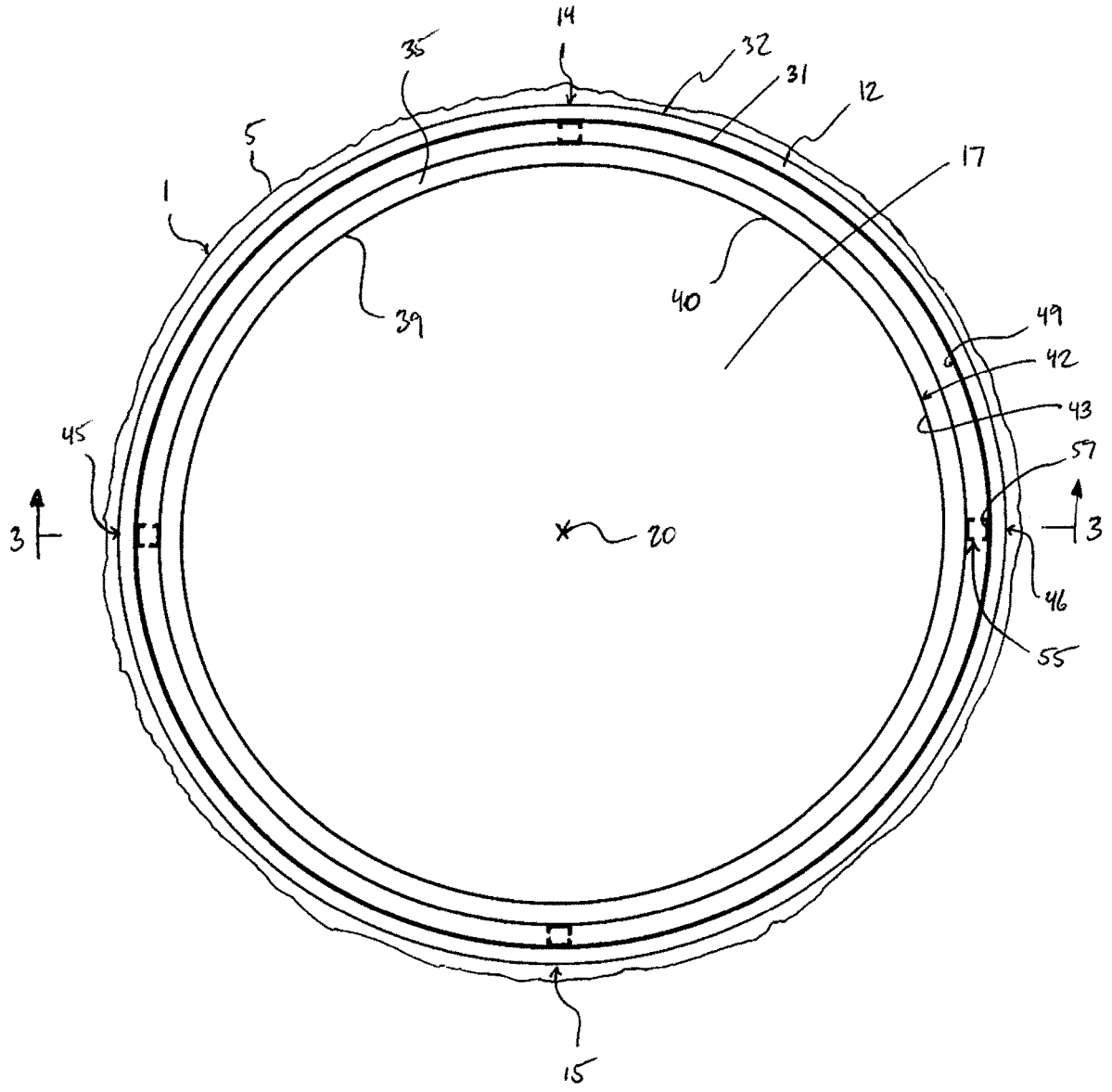
FIG. 2 is a top plan view of the arrangement of FIG. 1.
Figure 3:
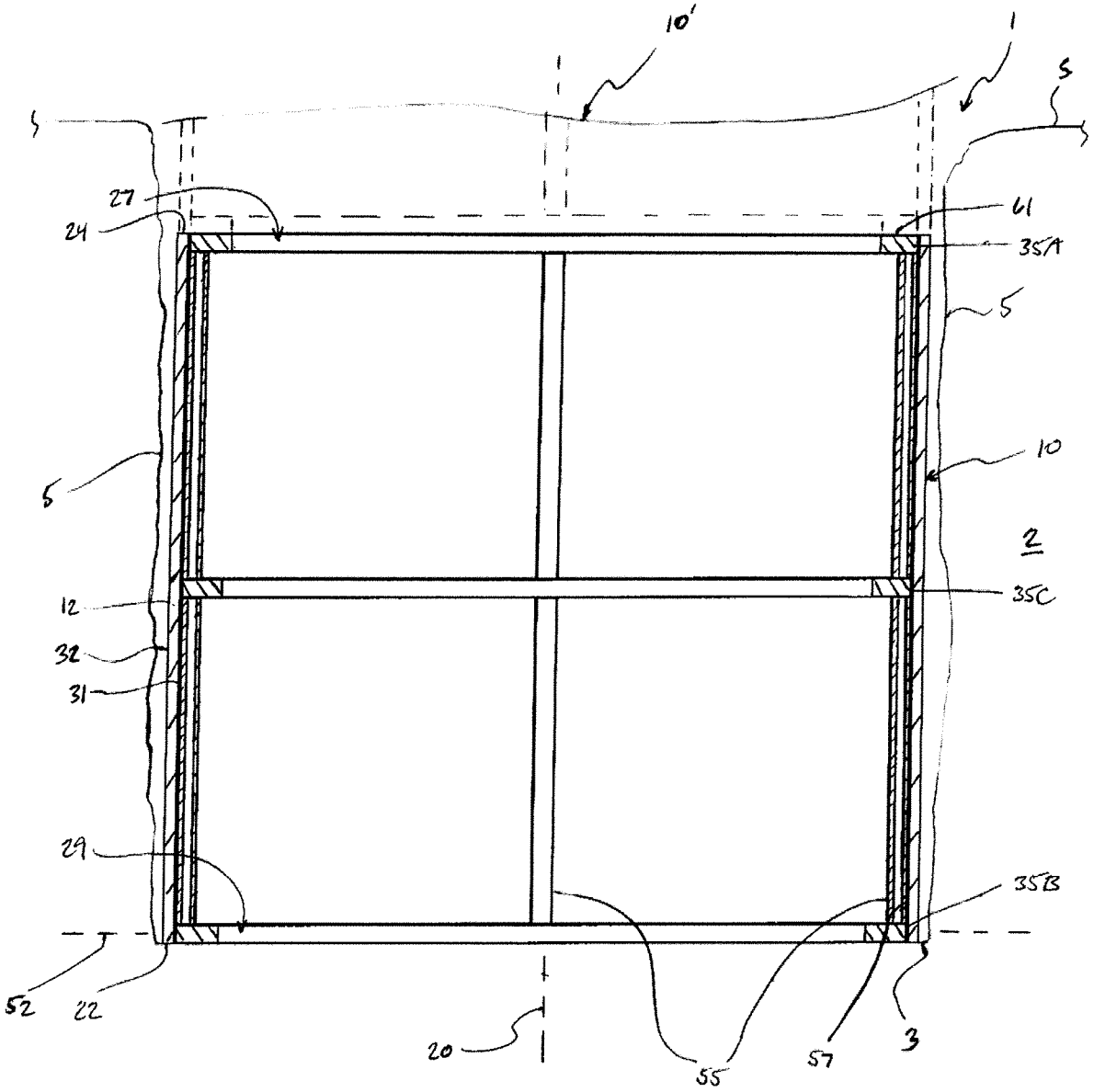
FIG. 3 is a cross-sectional view along line 3-3 in FIG. 2.

In the accompanying figures there is shown an apparatus 10 for removable insertion into an excavated trench 1 as more clearly shown in FIGS. 2 and 3. The excavated trench 1 is formed in a ground material 2 such as soil and has a trench floor 3 at a depth below a ground surface S and an upright peripheral trench wall 5 extending upwardly from the floor to the ground surface. As such, the apparatus 10 is used to protect a worker in the excavated trench 1 against collapse of the peripheral trench wall 5. This type of apparatus is typically termed in industry as a trench shield or box or cage.

The apparatus 10 comprises an upright protective peripheral wall 12 having substantially diametrically opposite first and second sides 14, 15 arranged to define a generally enclosed working area 17 suited for receiving a worker therein. That is, at least the protective peripheral wall has a portion at each of the first and second sides and defines therebetween the working space 17. The protective peripheral wall 12 therefore generally encompasses an upstanding axis 20 and extends from a bottom 22 of the protective peripheral wall which is arranged to be located at or adjacent the trench floor 3 to a top 24 of the protective peripheral wall arranged to be located at a spaced height above the trench floor 3. Thus the protective peripheral wall 12 acts to prevent collapsing movement into the working area of the ground material forming the peripheral trench wall 5 at least at the substantially diametrically opposite locations of the working area 17 corresponding to the first and second sides 14, 15.

The protective peripheral wall 12 defines between the first and second sides thereof 14, 15 an entry opening 27 at the top 24 of the protective peripheral wall for entering the working area 17 and an access opening 29 at the bottom 22 of the protective peripheral wall for providing access to the trench floor 3. Typically, with the apparatus 10 already located in the trench 1, the worker lowers a ladder or other entry device independent from the apparatus into the working space 17 and descends the ladder so as to pass from outside the trench through the entry opening 27 and into the working space 17 delimited by the apparatus 10. The access opening 29 leaves the trench floor 3 substantially unobstructed by location of the apparatus 10 in the trench so as to perform the desired work in the trench.

The protective peripheral wall 12 has an interior surface 31 facing the working area 17 and an exterior surface 32 for facing the peripheral trench wall 5. The interior and exterior surface 31, 32 are separated by a thickness of the protective peripheral wall 12.

The apparatus 10 further includes a plurality of cross members 35 disposed at spaced locations across a height of the protective peripheral wall, which is measured between the bottom 22 of the protective peripheral wall and the top 24 thereof, and interconnecting the first and second sides 14, 15 of the protective peripheral wall 12 so as to maintain the first and second sides thereof in fixed spaced relation to one another.

The cross members 35 extend from the interior surface 31 at the first side 14 of the protective peripheral wall to the interior surface 31 at the second side 15 of the protective peripheral wall and form at spaced locations across the height of the protective peripheral wall 12 a plurality of rounded annuluses each including opposite first and second arcs 39, 40 extending from the first side 14 to the second side 15. For example, the annuluses may be elliptical in shape. Generally speaking, the arcs 39, 40 of a common annulus are located in a common plane and form mirror images of one another so as to be substantially identical aside from orientation. Furthermore, the arcs 39, 40 are mounted to the protective peripheral wall at proximally adjacent locations thereon, so that they generally converge at their mounting locations on the wall 12 to form the annulus.

Each rounded annulus encircles or surrounds the working area 17 and an aperture 42 defined by an inner side 43 of the annulus is sized substantially equal to the working area 17 such that the working area is substantially unobstructed by the cross members 35 forming the annuli. Thus, a single annulus can be provided at each height location across the protective peripheral wall 12.

The protective peripheral wall 12 forms a tube extending along the upstanding axis 20 around the cross members 35, such that the cross members 35 are located within a periphery defined by the wall 12, so as to substantially fully enclose the working area 17 to prevent the collapsing movement into the working area of the ground material 2 at any location on the peripheral trench wall 5 around the working area. Thus the protective peripheral wall 12 is tubular in shape from the bottom 22 to the top 24.

As the protective peripheral wall 12 wholly surrounds the working area 17, the protective peripheral wall 12 includes, further to the sides 14 and 15, first and second ends 45, 46 which are substantially diametrically opposite one another in a manner which is crosswise to the substantially diametrically opposite relation of the first and second sides 14, 15, all of which are defined by a common member that being the wall 12. The first and second ends 45, 46 of the protective peripheral wall are connected to the opposite first and second arcs 39, 40 of each annulus formed by the cross members 35 such that the annulus also extends from the interior surface 31 of the protective peripheral wall at the first end 45 to the interior surface 31 at the second end 46 so as to maintain the first and second ends 45, 46 in fixed spaced relation to one another.

The interior surface 31 of the protective peripheral wall 12 follows the common shape of the annuluses and is connected to outer sides 49 of the annuluses. Preferably the whole of the protective peripheral wall 12 has a common shape as that of the annuluses so as to provide a wall of uniform thickness between the interior and exterior surfaces 31, 32 thereof.

In the illustrated arrangement, each of the cross members 35 is in the form of a closed loop so as to form both the first and second arcs 39, 40 of the annulus. Thus the arcs 39, 40 of each annulus are interconnected, so as to converge, to form an endless loop which is coupled to the protective peripheral wall 12 at a single location on the loop at each of the sides 14, 15. Thus each cross member of the illustrated arrangement is annular in shape. Furthermore, in the illustrated arrangement the arcs 39, 40 are integrally formed by a unitary member.

Furthermore, each annulus is of a common shape, and as more clearly shown in FIG. 2 is specifically is circular in shape, or in other words circular elliptical in shape, so as to be wholly rounded in shape and such that each of the arcs 39, 40 is semi-circular in shape. As such, the protective peripheral wall 12 of the illustrated arrangement is circular cylindrical in shape as more clearly shown in FIG. 2 so as to correspond to the shape of the annuli 35 each of which have the same size in terms of both outer diameter at diametrically opposite locations on the outer side 49 as well as inner diameter at the aperture 42.

Each annulus defines a plane 52 which is oriented transversely to the upstanding axis 20. In the illustrated arrangement, the plane 52 of the annulus is oriented perpendicularly transverse to the axis 20.

Also, centers of the annuluses are coaxially aligned along the upstanding axis 20 located centrally of the working area 17. Thus the annuli or rings 35 are oriented in a manner which is less obstructive of the working area 17 and furthermore they can be substantially sized and shaped one like the other such that the tube can be substantially cylindrical.

Further to the cross members 35, the apparatus 10 further includes a plurality of frame members 55 interconnecting adjacent ones of the cross members 35 which are spaced apart in a direction of the height of the protective peripheral wall 12. Specifically each adjacent pair of the cross members are interconnected by at least one frame member 55.

As more clearly shown in FIGS. 2 and 3, the frame members 55 interconnect the adjacent cross members 35 at locations thereon so as to be disposed at the interior surface 31 of the protective peripheral wall 12. More specifically, the frame members are disposed at the interior surface 31 at least at the first and second ends 45, 46 so as to be connected to the protective peripheral wall at the first and second ends. As such, an outer side 57 of each frame member 55 is connected to the interior surface 31 of the wall 12. Furthermore, the outer sides 57 of the frame members are substantially flush with the outer sides 49 of the annuli.

In the illustrated arrangement, the frame members 55 also are provided at the first and second sides 14, 15. Furthermore, a plurality of frame members 55 are provided interconnecting the adjacent pair of the cross members at angularly spaced locations about the annuli.

Thus the interconnecting frame members 55 further brace the protective peripheral wall 12 such that the tube may be reduced in mass, for example by reducing the thickness of the protective peripheral wall 12, while remaining suitably strong to retain any collapsing ground material outside the working area.

The interconnecting frame members 55 act to bridge between the cross members 35 forming annuli at spaced heights across the wall 12 so as to form an interconnected internal frame of the apparatus within a periphery defined by the protective peripheral wall 12 that primarily provides a compressive strength to the structure radially of the upstanding axis 20. The wall 12 primarily acts as a sheathing or cover so as to prevent the ground material at the trench wall 5 from entering the working area 17, and thus can be made relatively thin. This cover is connected at an outer side of the frame.

In the illustrated arrangement, a first one of the annuluses indicated at 35A in FIG. 3 is located at the top 24 of the protective peripheral wall 12 and a second one of the annuluses indicated at 35B is located at the bottom 22 of the protective peripheral wall. A third one of the annuluses 35C is located centrally between the top 24 and the bottom 22 of the protective peripheral wall. This arrangement is suitable for a structure having an overall height of about 48 inches or 4 feet. Each adjacent pair of the annular cross members 35 is linked by a plurality of upright linearly extending frame member 55 which are substantially equidistantly spaced relative angularly of the upstanding axis 20 or, in other words, circumferentially of each annulus.

An upper surface 61 of the first annulus 35A which is arranged to face upwardly out of the trench is substantially flush with the top 24 of the protective peripheral wall 12 and a lower surface 63 of the second annulus 35B, which is arranged to face downwardly and be located at or adjacent the trench floor 3, is substantially flush with the bottom 22 of the protective peripheral wall such that another apparatus 10', a lower portion of which is shown in phantom in FIG. 3, can be stacked on top in coaxial alignment. The surfaces of the cross members in cooperation with upper and lower ends of the wall 12 therefore collectively provides a larger surface area for supporting a like apparatus 10' stacked on top of a first 10 disposed at or adjacent the trench floor 3. Therefore, the apparatus may be provided in generally shorter heights to further reduce its mass so as to render the apparatus more readily movable by hand without assistance of other equipment.

It will be appreciated that the frame members 55 are tubular and each annular cross member 35 is formed from a pair of concentric graduated annular shaped tubes which are interconnected at an inner side of a larger outer one of the annular tubes and at an outer side of a smaller inner one of the annular tubes, for example by welding. It will be appreciated that in FIG. 3 the annular cross members 35 show a solid cross-section only for convenience of illustration.

In use, a trench 1 is excavated in a ground material 2 to a suitable depth beneath the ground surface S. The apparatus 10 is lowered into the trench so as to rest on the trench floor 3. Where the depth of the trench between the trench floor 3 and the ground surface S exceeds the height of a single apparatus to a suitable amount, a second apparatus 10' may be lowered into the trench and on top of the first apparatus already in the trench such that the apparatuses 10, 10' stack.

Typically, the trench 1 is formed to substantially conform to the footprint of the apparatus 10, that is, its (cross-sectional) size and shape substantially match that of the apparatus 10, so as to minimize disturbance of the ground material in forming the trench.

The trench receiving the substantially fully peripherally enclosed apparatus 10 is preferably formed with a hydro excavator as termed in the art which uses water and vacuums to excavate a trench as is known in the art. (Thus the hydro excavator is not described in further detail herein.) The apparatus 10 is located in its upstanding condition with the bottom 22 of the protective peripheral wall 12 rested on the ground surface S in the location where the trench is to be formed. As the protective peripheral wall 12 is fully enclosed, it delimits a defined closed periphery, and so, with the apparatus 10 rested on the ground surface, the hydro excavator can be used to remove the ground material 2 starting at the surface S within the defined interior periphery, that is the area on the surface S defined by the working area 17 of the apparatus, and continuing to remove the ground material through the interior of the apparatus until the apparatus is displaced below the ground surface S as it remains substantially in the same location and position as before. Thus the trench 1 can be formed to snugly receive the apparatus 10 therein, so as to reduce the likelihood of the ground material at the trench wall 5 collapsing.

FIGS. 4 through 7 relate to another arrangement of the apparatus indicated at 10' which is formed from a plurality of sections such as those indicated at 66 and 67, each of which comprises a portion of the protective peripheral wall and portions of the cross-members.

More specifically, the protective peripheral wall 12' comprises a first portion 68 defining the first side 14 of the protective peripheral wall and a second portion 69 defining the second side 15 of the protective peripheral wall such that the separate wall portions, which are distinct from one another, define diametrically opposite portions of the protective peripheral wall. Each portion 68, 69 of the wall 12' extends angularly of the upstanding axis 20 between opposite substantially vertically extending ends 71 and 72. In the illustrated arrangement 10', the tubular peripheral wall 12' is divided into two substantially identical halves, each of which spans about 180 degrees between its opposite ends 71 and 72 relative to the upstanding axis 20. As the tube formed by the apparatus is circular cylindrical in shape, each wall portion 68, 69 is semi-circular in shape between the opposite ends 71, 72. Furthermore, each wall portion 68, 69 is shaped in a manner which is self-standing or, in other words, self-upright or vertically supporting.

Furthermore, in the second arrangement 10', each annular cross member 35' comprises a first arcuate portion 75 attached to the first portion 68 of the protective peripheral wall so as to form a first reinforced wall portion 66 and a second arcuate portion 76, which is separate from the first arcuate portion, attached to the second portion 69 of the protective peripheral wall so as to form a second reinforced wall portion 67. Each arcuate portion of the cross member is unitarily attached to the corresponding one of the wall portions such that each reinforced wall portion is unitary and can be lowered into the trench as a single component for subsequent assembly to form a fully surrounding trench cage. As such, the first and second reinforced wall portions 66, 67 are directly interconnectable in an assembled condition without any spreaders or struts so as to form the fully surrounding trench cage. This is achieved by butting engagement of the ends 71, 72 of the sections 66, 67. At the ends 71, 72 there is provided at least one securing device 78, such as a locking pin 79 (schematically shown) which can be passed through registrable apertures 80 formed in the abuttable ends 71, 72, or a latch (not shown) with cooperating portions on different sections 66, 67, so that the cooperating sections 66, 67 can be connected in fixed relation to one another in the assembled condition. In the assembled condition, the first and second arcuate portions 75, 76 of the cross members 35' form the rounded annuluses and the first and second portions 68, 69 of the protective wall 12' form the tube.

As in the previously illustrated and described arrangement 10, frame members 55' are provided in the form of thin bars to interconnect adjacent cross members 35'.

Additionally, in the second illustrated arrangement, the portions 75, 76 of the top and bottom cross members 35A' and 35B', as well as the frame members 55A' and 55B' which are disposed at the periphery of the wall portion 68, 69, are integral with the respective wall portion so as to be formed of a single sheet of metallic material.

Thus, in use of the second arrangement 10', after the trench 1 is formed, each reinforced wall portion 66, 67 can be lowered individually into the trench 1 for subsequent connection to the other section with which it collectively forms the fully encompassing apparatus 10'. This further reduces a mass of each component to be lowered into the trench.

Once work in the trench has been completed, the sections 66, 67 can be disconnected from one another so as to be removed from the trench one at a time.

Figure 4:
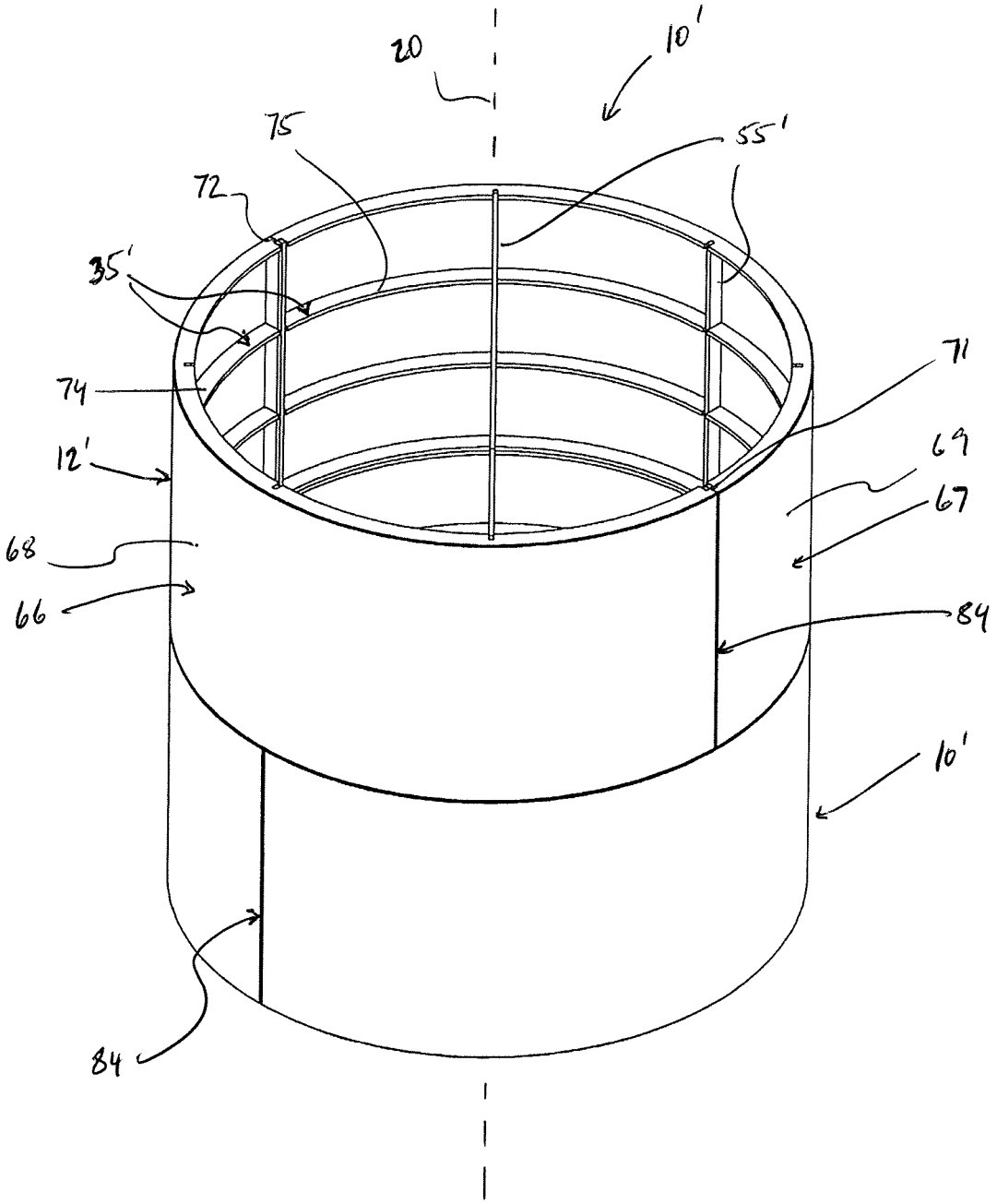
FIG. 4 is a perspective view of another arrangement of apparatus for removable insertion into an excavated trench according to the present invention.
Figure 5:
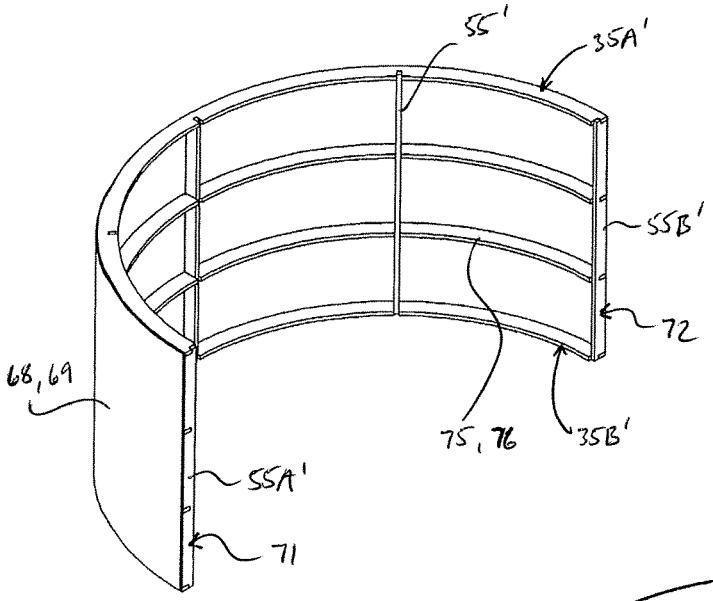
FIG. 5 is a perspective view of a portion of the second arrangement which is shown in FIG. 4.
Figure 6:
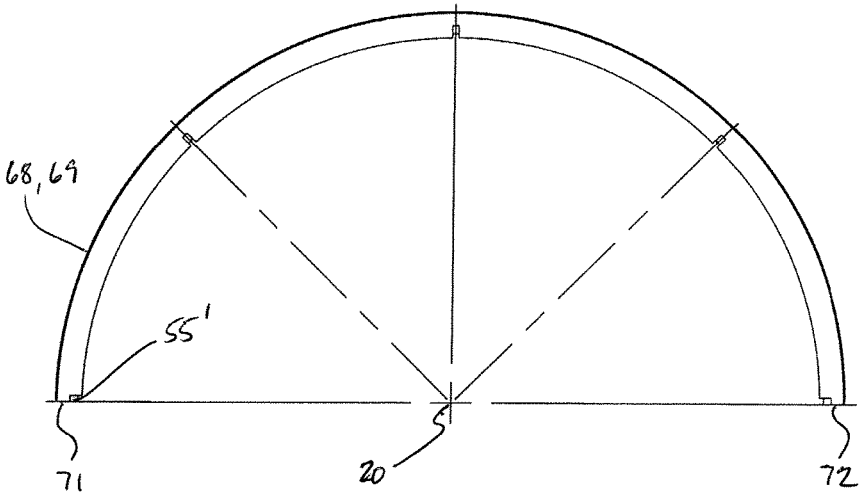
FIG. 6 is a plan view of the portion of the second arrangement of FIG. 5.
Figure 7:
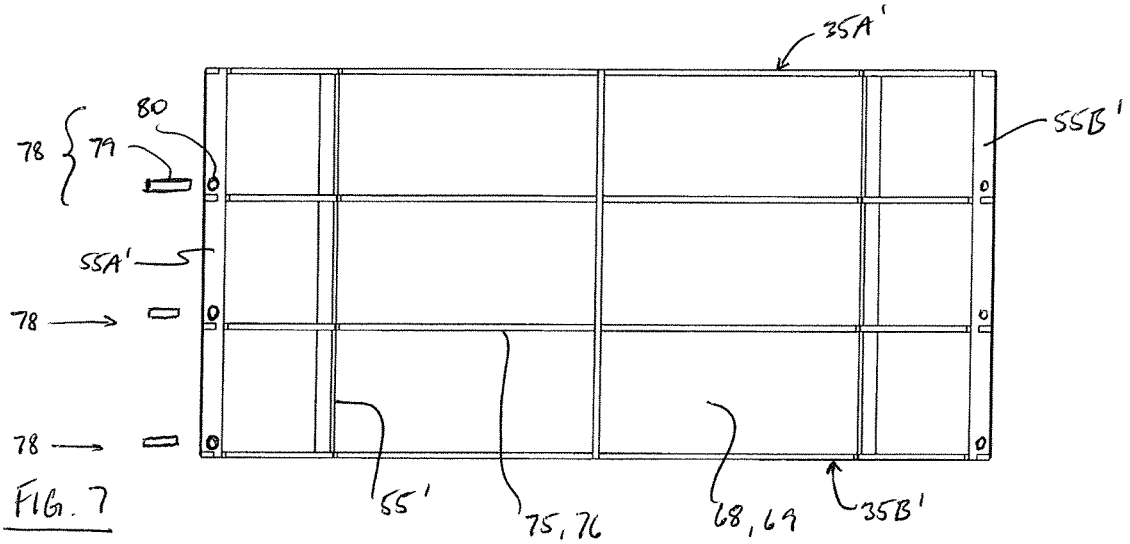
FIG. 7 is an interior elevational view of the portion of the second arrangement of FIG. 5.

Referring to FIG. 4, when a plurality of the apparatuses 10' are vertically stacked, joints 84 of the assembled multi-piece trench cages, which are formed by abutted ends 71, 72, may be angularly spaced or offset from the joints of an adjacent one of the trench cages such that the joints 84 of the stacked trench cages are staggered or misaligned so as to reduce shear-like strain in a vertical direction on the joints 84.

The scope of the claims should not be limited by the preferred embodiments set forth in the examples but should be given the broadest interpretation consistent with the specification as a whole.

The invention claimed is:

1. A method for excavating and preventing collapse of a trench in ground material to receive a worker therein comprising:

providing an upstanding tubular wall having a cylindrical exterior surface from an open top of the tubular wall to an open bottom thereof, wherein the upstanding tubular wall has an interior between the open top and the open bottom and configured to receive the worker therein;

arranging the upstanding tubular wall in contact with a surface of the ground material;

after arranging the upstanding tubular wall in contact with the surface of the ground material, removing ground material underneath the tubular wall through the interior thereof until the open bottom of the tubular wall is located at a prescribed depth below the surface of the ground material to define a floor of the trench, whereby the trench is excavated to conform to an exterior cross-section across a height of a portion of the upstanding tubular wall below the surface of the ground material and whereby the tubular wall is lowered into the ground material by gravity when the ground material is removed from underneath the upstanding tubular wall;

after removing ground material underneath the tubular wall to excavate the trench and lower the tubular wall into the ground material, leaving the tubular wall in the trench in the ground material to reinforce the trench until work to be performed by the worker in the trench has been completed and leaving the interior of the tubular wall free of filler material to define, within said interior, a working space for the worker to perform the work, wherein the working space is adjacent the floor of the trench on which the open bottom of the tubular wall is resting; and after the work in the trench has been completed by the worker, removing the tubular wall from the ground material.

2. The method of claim 1 wherein removing ground material through the interior of the tubular wall to excavate the trench and lower the tubular wall into the ground material is performed using hydro excavation.

3. The method of claim 1 wherein, when the prescribed depth of the floor of the trench exceeds a height of the tubular wall between the open top and the open bottom thereof, the method further includes:

before a depth of the trench relative to the surface of the ground material exceeds the height of the tubular wall, stacking, onto the tubular wall in the ground material in coaxial alignment therewith, another tubular wall having:

a cylindrical exterior surface between an open top of said another tubular wall and an open bottom thereof and having a matching exterior cross-section to the tubular wall in the ground material across a full height of said another tubular wall; and an interior between the open top of said another tubular wall and the open bottom thereof and configured to receive the worker therein.

4. The method of claim 3 wherein said another tubular wall is formed from a plurality of interconnectable self-standing arcuate wall sections.

5. The method of claim 4 wherein stacking said another tubular wall onto the tubular wall in the ground material comprises stacking the arcuate wall sections one at a time onto the tubular wall in the ground material and interconnecting the arcuate wall sections to form said another tubular wall on top of and coaxial with the tubular wall in the ground material.

6. The method of claim 4 wherein the arcuate wall sections are substantially identical to each other.

7. The method of claim 4 wherein each arcuate wall section spans 180 degrees around an upstanding axis thereof.

8. The method of claim 1 wherein, when the tubular wall encompasses an axis, the tubular wall comprises tubular sheathing encompassing the axis and a frame internal to the tubular sheathing and attached to an interior surface thereof, wherein the frame includes annular members encompassing the axis and arranged at axially spaced positions of the tubular sheathing and axially-extending cross members of the frame interconnecting the annular members.

* * * * *